US010669774B2

(12) United States Patent
Hunsinger et al.

(10) Patent No.: US 10,669,774 B2
(45) Date of Patent: Jun. 2, 2020

(54) BLIND

(71) Applicant: SPP Industries Holdings Pty Ltd, South Brisbane (AU)

(72) Inventors: John Hunsinger, Brisbane (AU); Donald Craig Hailes, Brisbane (AU); Christopher Francis Hart, Brisbane (AU)

(73) Assignee: SPP Industries Holdings Pty Ltd, South Brisbane QLD (AU)

( * ) Notice: Subject to any disclaimer, the term of this patent is extended or adjusted under 35 U.S.C. 154(b) by 0 days.

(21) Appl. No.: 15/572,846

(22) PCT Filed: May 12, 2016

(86) PCT No.: PCT/AU2016/050358
§ 371 (c)(1),
(2) Date: Nov. 9, 2017

(87) PCT Pub. No.: WO2016/179660
PCT Pub. Date: Nov. 17, 2016

(65) Prior Publication Data

US 2018/0128045 A1 May 10, 2018

(30) Foreign Application Priority Data

May 12, 2015 (AU) ..... 2015901725

(51) Int. Cl.
*E06B 9/262* (2006.01)
*E06B 9/323* (2006.01)
*E06B 9/322* (2006.01)

(52) U.S. Cl.
CPC ..... *E06B 9/262* (2013.01); *E06B 9/322* (2013.01); *E06B 9/323* (2013.01); *E06B 2009/2622* (2013.01)

(58) Field of Classification Search
CPC ..... E06B 2009/2622; E06B 9/26
(Continued)

(56) References Cited

U.S. PATENT DOCUMENTS 4,934,437 A 6/1990 Kraeutler
5,273,096 A 12/1993 Thomsen et al.
(Continued)

FOREIGN PATENT DOCUMENTS

AU 2007202581 B2 1/2012

OTHER PUBLICATIONS

Int'l Search Report and Written Opinion dated Jul. 4, 2016 in Int'l Application No. PCT/AU2016/050358.

*Primary Examiner* — Johnnie A. Shablack
(74) *Attorney, Agent, or Firm* — Panitch Schwarze Belisario & Nadel LLP

(57) ABSTRACT

A Roman blind includes a panel having a plurality of battens attached thereto. Each of the battens includes a rear slot, with at least one control band extending along a rear surface of the panel. Raising a lower end of the at least one control band causes the blind to be raised and lowering a lower end of the at least one control band causes the blind to be lowered. One or more band guides are mounted in the rear slot of one or more of the battens. The one or more band guides mounted in the rear slot of a batten that is not a lowermost batten is/are mounted for slidable movement within the rear slot so that the one or more band guides float in the rear slot. The position of the band guides is self-adjusting. Manufacturing of the blind is consequently less complex.

17 Claims, 7 Drawing Sheets

(58) Field of Classification Search
USPC ..... 160/84.01, 84.04, 264
See application file for complete search history.

(56) References Cited

U.S. PATENT DOCUMENTS

| | | | | |
|---|---|---|---|---|
| 5,862,850 | A * | 1/1999 | Yang | E06B 9/262 160/264 |
| 6,257,300 | B1 * | 7/2001 | Brownlie | A47H 23/00 160/264 |
| 6,854,500 | B2 * | 2/2005 | Chen | E06B 9/262 160/84.01 |
| 7,124,802 | B2 * | 10/2006 | Sudano | E06B 9/264 160/89 |
| 8,267,144 | B2 * | 9/2012 | Hsu | E06B 9/262 160/264 |
| 8,281,842 | B2 * | 10/2012 | Lin | E06B 9/262 160/309 |
| 8,967,226 | B2 * | 3/2015 | Vestal | E06B 9/262 160/321 |
| 9,004,140 | B2 * | 4/2015 | Hailes | E06B 9/262 160/405 |
| 9,121,219 | B2 * | 9/2015 | Ng | E06B 9/262 |
| 9,909,360 | B2 * | 3/2018 | Goldberg | E06B 9/262 |
| 2007/0235147 | A1 * | 10/2007 | Zakowski | E06B 9/262 160/84.04 |
| 2010/0294438 | A1 * | 11/2010 | Kirby | E06B 9/262 160/84.04 |
| 2011/0186240 | A1 * | 8/2011 | Lin | E06B 9/262 160/84.01 |
| 2011/0192550 | A1 * | 8/2011 | Williams, III | A47H 2/00 160/84.04 |
| 2011/0289735 | A1 * | 12/2011 | Barnes | E06B 9/262 24/129 R |
| 2011/0308745 | A1 | 12/2011 | Vestal et al. | |
| 2012/0031569 | A1 * | 2/2012 | Elinson | E06B 9/262 160/127 |
| 2012/0067527 | A1 * | 3/2012 | Cheng | E06B 9/262 160/84.02 |
| 2012/0097342 | A1 * | 4/2012 | Tu | E06B 9/262 160/84.04 |
| 2012/0103538 | A1 * | 5/2012 | Gleinser | E06B 9/262 160/84.04 |
| 2014/0041812 | A1 | 2/2014 | Strand et al. | |
| 2015/0075726 | A1 * | 3/2015 | Byun | E06B 9/262 160/84.04 |
| 2016/0160558 | A1 * | 6/2016 | Strand | E06B 9/262 160/84.01 |
| 2016/0258210 | A1 * | 9/2016 | Goldberg | E06B 9/384 |

* cited by examiner

BLIND

CROSS-REFERENCE TO RELATED APPLICATION

This application is a Section 371 of International Application No. PCT/AU2016/050358, filed May 12, 2016, which was published in the English language on Nov. 17, 2016, under International Publication No. WO 2016/179660 A1, and the disclosure of which is incorporated herein by reference.

TECHNICAL FIELD

The present invention relates to an improved blind. More particularly, the present invention relates to an improved Roman blind.

BACKGROUND ART

Roman blinds are a widely used window covering. A Roman blind typically comprises a sheet of fabric having a number of spaced horizontal rods attached to the fabric. In some Roman blinds, the horizontal rods are mounted in pockets sewn into the back of the sheet of the fabric. In other Roman blinds, the rods comprise fabric slots into which the fabric is positioned and retained. Reference is made to our Australian patent number 2007202581, the entire contents of which are incorporated herein by cross-reference, which describes a rod or batten having a fabric slot which receives a portion of the sheet of fabric. A retaining member, which will typically be in the form of a thin rod, is then inserted into the fabric slot above the fabric to thereby retain the fabric in the fabric slot. This effectively mounts the rod or batten to the fabric. As stated above, a number of spaced horizontal rods buttons are mounted to the fabric.

In order to raise the blind, a series of control cords extend along the back surface of the fabric. The control cords are attached to a rod or batten located at the bottom of the fabric sheet. The control cords pass through cord guides, which are typically arranged to be mounted to the horizontal rods or battens and typically comprise a loop. The cord guides allow the control cords to slide therethrough. The upper ends of the control cords are attached to a roller or a spool. In order to raise the Roman blind, the roller or spool is caused to rotate such that the control cords wind up on the roller or spool. As the control cords are attached to the bottom horizontal rod, this lifts the fabric. As the fabric is lifted, the bottom horizontal rod comes into contact with the adjacent horizontal rod. Continued raising of the control cords results in both horizontal rods being raised until the next adjacent horizontal rod is contacted, and so forth. When the Roman blind is fully raised, the fabric forms a series of neatly folded pockets having an appealing aesthetic.

Roman blinds will also typically include a headrail or a header. The headrail or header will normally include the roller or spool as well as appropriate operating mechanisms to enable the blind to be raised and lowered. The operating mechanisms may range from chain and pulley mechanisms, clutch assisted mechanisms, motorised driven mechanisms or spring assisted clutch actuated mechanisms (which will typically include spring actuated clutch mechanisms that enable the blind to be pulled down and be held at any desired location and also enable the blind to fully retract by a person pulling down on the blind and releasing the blind). The operating mechanisms that can be used in Roman blinds are varied and well known in the art.

Although Roman blinds are in widespread use, concerns have been expressed that they have the potential to present a strangulation risk to small children. In particular, attachment of the control cords behind the sheet of material to the bottom batten or to a hembar and passage of the control cords through the guide loops means that there is a risk that a small child could pass his or her head between a control cord and the sheet of material and subsequently have the control cord engage with his or her neck, thereby forming a strangulation risk.

Some efforts have been made to ameliorate this strangulation risk. For example, in some Roman blinds, the control cords are located in pockets that are sewn to the back of the sheet of material. This increases manufacturing costs and can lead to unsightly bagging in the fabric.

In United States patent application publication number 2011/0192550, the control cords were replaced with wide tapes. The tapes passed through guides having horizontal slots formed in them in order to guide to the control tapes. The guides were sewn to the back of the fabric used in the Roman blind.

It will be clearly understood that, if a prior art publication is referred to herein, this reference does not constitute an admission that the publication forms part of the common general knowledge in the art in Australia or in any other country.

SUMMARY OF INVENTION

The present invention is directed to a Roman blind, which may at least partially overcome at least one of the above-mentioned disadvantages or provide the consumer with a useful or commercial choice.

With the foregoing in view, the present invention in one form, resides broadly in a Roman blind comprising a panel having a plurality of battens attached thereto, each of the battens including a rear slot, at least one control hand extending along a rear surface of the panel, wherein raising a lower end of the at least one control hand causes the blind to be raised and lowering a lower end of the at least one control band causes the blind to be lowered, and one or more band guides being mounted in the rear slot of one or more of the battens, wherein the one or more band guides mounted in the rear slot of a batten that is not a lowermost batten is/are mounted for slidable movement within the rear slot so that the one or more band guides float in the rear slot.

By having the band guides mounted for slidable movement in the rear slots of the battens that are not the lowermost batten so that the one or more band guides float in the rear slot, completely accurate positioning of the band guides in those battens is not required to during manufacture or assembly of the Roman blind. In this regard, it will be appreciated that if operation of the control band or bands causes an edge of the control band or bands to come into contact with one of the band guides due to the band guides not being perfectly aligned, as the band guide is mounted for slidable movement, the band guides can simply slide due to the action of the edge of the band contacting the band guide. In this manner, the slidable band guide is automatically brought into position. The band guides that are mounted to the battens that are not the lowermost batten may be thought of as being self aligning band guides or freely floating band guides.

In some embodiments, each of the battens that are not the lowermost batten are provided with one or more band guides. Suitably, each batten that is not the lowermost batten is provided with a number of band guides that corresponds to the number of control bands included in the Roman blind.

The band guides may comprise an opening through which a control band can pass and a mounting arrangement for mounting the band guide in the rear slot of a batten. In one embodiment, the rear slot of the batten opens into a channel in the batten and the band guides comprise a body having an opening formed therein, the opening having a dimension that is slightly larger than a control band, the body further including a mounting arrangement comprising a neck portion extending into a head portion, the neck portion and head portion being dimensioned such that the head portion fits into the channel of the rear slot and is retained in the channel of the rear slot. In this arrangement, the neck portion can be aligned with the open edges of the rear slot and the head portion can be located in the channel and below the open edges of the rear slot, and the band guide can then be slid along the rear slot to thereby position the band guide. In this arrangement, the band guide cannot be removed from the rear slot by pulling the band guide away from the plane of the panel as the head portion of the band guide engages with the underside of the edges of the rear slot, thereby preventing removal of the band guide in that direction.

In one embodiment, the neck of the mounting arrangement of the band guide has a width that is smaller than a width of the longitudinal opening of the rear slot. The neck of the mounting arrangement of the band guide may have a depth that is larger than a wall thickness of an edge of the rear slot. The head of the mounting arrangement of the band guide may have a depth that is smaller than a depth of the channel of the rear slot. The head of the mounting arrangement of the band guide may have a width that is smaller than a width of the channel of the rear slot. In this manner, the neck and head of the mounting arrangement of the band guide do not become tightly engaged within the channel or the rear slot, thereby enabling the band guide to freely float along the length of the rear slot.

In one embodiment, the neck of the band guide is from 0.2 to 0.5 millimeters narrower than the corresponding longitudinal opening of the rear slot, more preferably from 0.2 to 0.3 mm narrower than the corresponding longitudinal opening of the rear slot, even more preferably about 0.25 mm narrower than the corresponding longitudinal opening of the rear slot. The head portion of the mounting arrangement of the band guide may be from 0.3 to 0.7 mm smaller in width than the width of the channel, more suitably from 0.4 to 0.6 mm smaller in width, even more preferably about 0.5 mm smaller in width than the channel. The head portion of the mounting arrangement the band guide may have a depth dimension that is from 0.2 to 0.5 mm smaller than the corresponding inside dimensions of the channel, more preferably from 0.2 to 0.3 mm smaller than the depth dimension of the channel, even more preferably about 0.25 mm smaller in depth than the corresponding inside dimension of the channel. The neck of the mounting arrangement of the band guide may have a height that is from 0.15 to 0.4 mm larger than the thickness of the wall of the rear slot, or preferably from 0.2 to 0.3 mm larger than the thickness of the wall the rear slot, even more preferably about 0.2 mm larger than the thickness of the wall of the rear slot. It will be appreciated that other dimensions that also achieve the result of having the band guide freely float in the rear slot and rear channel of the batten also fall within the scope of the present invention.

The band guide may have a shoulder located on an opposite end of the neck to the head and the distance between the head of the band guide and the shoulder of the band guide may be from 0.4 mm to 0.7 mm greater than the wall thickness of the rear slot, more preferably about 0.5 mm greater than the wall thickness of the rear slot.

In one embodiment, the mounting arrangement of the band guide has rounded corners so as to not catch on any side or surface of the channel. In one embodiment, the outside surfaces of the band guide are smooth surfaces so as to not catch on any exterior surface of the batten or the rear slot.

In one embodiment, the batten is made from extruded aluminium and the hand guide is made from a plastic material. The plastic material is suitably a rigid plastic material. Plastic material suitably does not catch on or stick to the channel or the rear slot of the batten. In other embodiments, the band guide may also be made from other rigid materials.

In some embodiments, the lower end of each of the control bands is attached to a bottom part of the panel or to a lowermost batten. In other embodiments, the lower end of each of the control bands is arranged such that it cannot be raised above a lowermost batten or a lowermost band guide.

In some embodiments, the control bands are connected to a lower portion of the panel. In some embodiments, the control bands are connected to the lowermost batten, which, in practice, will be mounted at or near the bottom of the panel. In some embodiments, the lowermost batten is provided with a rear slot, band guides are mounted in the rear slot and fixed in positioned in the rear slot and the control band is fixed relative to the band guides in the lowermost batten.

In some embodiments, the bottom of the control bands are provided with a retainer to prevent the lower ends of the control bands from lifting through the lowermost band guide.

In other embodiments, the lower end of a control band passes through an opening of a band guide and the lower end of the control band is subsequently secured to the band guide or secured to itself at a position above the lowermost control band to thereby retain the lower end of the band guide in position relative to the lowermost band guide.

In some embodiments, the lower end of the control band is glued or otherwise affixed to the lowermost batten or to a band guide affixed to the lowermost batten.

In some embodiments, the bands have a width that is from 2 to 7 inches, more preferably from 4 to 6 inches (5 to 17.5 cm, more preferably from 10 to 15 cm). Suitably, the control bands have a width that is sufficiently wide to meet any applicable safety regulations or safety legislation that is relevant to strangulation risks.

In some embodiments, the control bands are made from thin bands of a plastic material, such as Mylar. In other embodiments, the control bands are made from thin bands of the fabric material or made from thin bands of a mesh material or made from thin bands of a nonwoven material.

The panel used in the Roman blind of the present invention will suitably comprise a sheet of material, such as a sheet of fabric, a sheet of woven material, a sheet of plastic material or a sheet of nonwoven material. The panel must be sufficiently flexible so that it can be lowered and raised in the manner of the Roman blind. The person skilled in the art will readily appreciate that there will be a wide variety of materials that can be used in the manufacture of Roman blinds in accordance with the present invention.

In some embodiments, the Roman blind of the present invention will also include a mechanism for raising and lowering the Roman blind. The mechanism may include a rotating spool or a rotating tube or roller onto which the control bands can wind and unwind. The rotating spool, tube or roller may be rotated using any mechanism known to be suitable to a person skilled in the art. These mechanisms include a chain and pulley mechanism in which a pulley is mounted at one end of the rotating spool, tube or roller and an operating chain extends over the pulley such that an operator pulling on the chain causes pulley to turn which, in turn, causes the spool, tube or roller to rotate to thereby raise or lower the blind. In other embodiments, a clutch mechanism incorporating a spring may be used. Such clutch mechanisms may be of numerous different constructions known to the person skilled in the art. These mechanisms enable a blind to be lowered to any desired level and to be held at that level. In order to raise the blind, an operator simply pulls or tugs down on the blind and releases the blind. This causes a spring to rotate the tube, roller or spool to thereby raise the blind. This mechanism is especially suitable because it does not require a chain for operation, which chain could itself be a strangulation risk. In another embodiment, the spool, roller or tube may be rotated by a motor drive. The motor drive may comprise an electric motor. The Roman blind may be provided with one or more operating switches to operate the motor. The Roman blind may be provided with a remote control unit to enable remote operation of the motor.

In some embodiments, the battens may be affixed to the panel by providing the battens with a front slot, inserting material from the panel into the front slot and then placing a retaining means in the front slot to thereby retain the material of the panel in the front slot. This affixes the batten to the panel. In one embodiment, the battens may be affixed to the panel as described in our Australian patent number 2007202581. In other embodiments, the battens may be affixed to the panel by sewing or by use of an adhesive. Indeed, the present invention encompasses all possible ways in which the battens may be affixed to the panel.

The battens used in the present invention may be made from any suitable material, such as plastic (for example, polycarbonate, polyvinyl, high-density polypropylene, etc), metal (such as aluminium or steel), wood or other materials. Similarly, the band guides may be made from a material, such as plastic, metal, wood or other materials. In desirable embodiments, the battens may be made from aluminium. The battens may comprise an aluminium extrusion. The band guides may be made from a plastic material. The band guides may be made by moulding.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

DESCRIPTION OF EMBODIMENTS

It will be understood that the drawings have been provided for the purposes of describing preferred embodiments of the present invention. Therefore, the skilled person will appreciate that the present invention should not be considered to be limited solely to the features as shown in the attached drawings.

Figure 1:
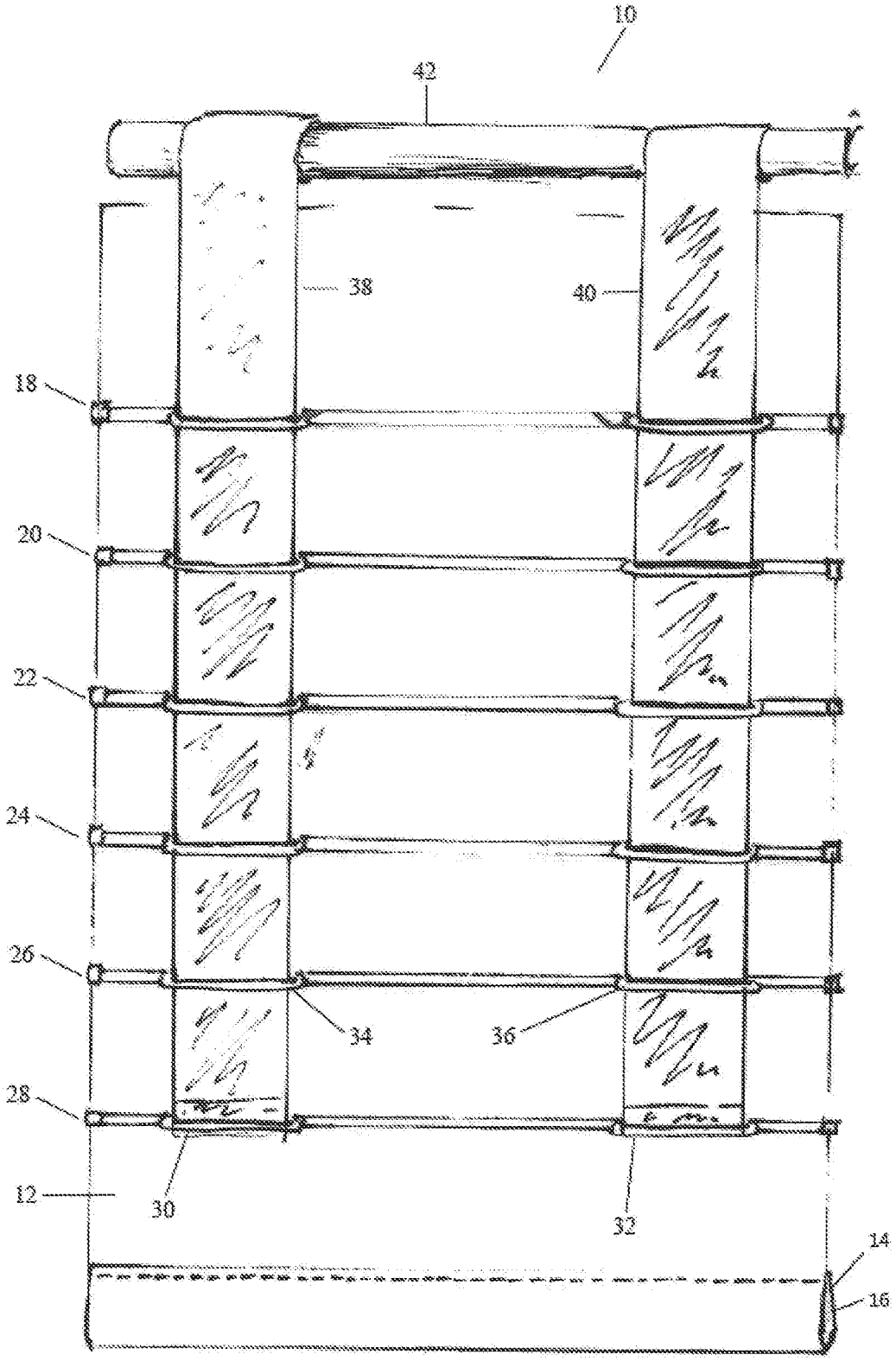
FIG. 1 shows a rear view of a Roman blind in accordance with one embodiment of the present invention.

FIG. 1 shows a rear view of a Roman blind 10 in accordance with the present invention. The Roman blind 10 includes a panel, generally denoted at 12. As will be understood by person skilled in the art, the panel 12 will normally comprise a sheet of material, such as a sheet of fabric. The sheet of fabric may be a woven fabric or a nonwoven fabric. The sheet of material 12 has a pocket 14 sewn into the bottom part thereof. A drawbar 16 is located within the pocket 14 to enable a user to operate the blind 10.

The Roman blind 10 further includes a plurality of horizontal battens affixed to the sheet of material 12. These battens are numbered as battens 18, 20, 22, 24, 26 and 28. The lowermost batten is formed by batten 28.

Figure 7:
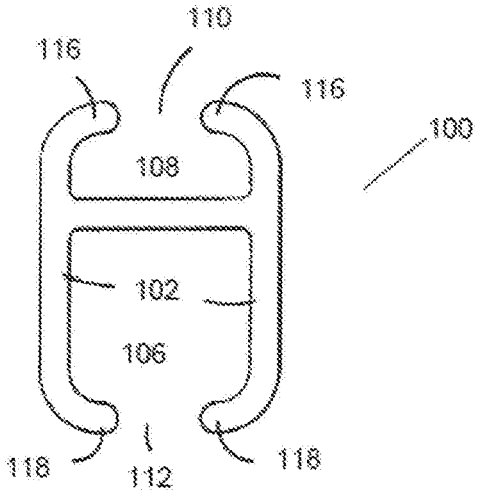
FIG. 7 shows an end view of a batten suitable for use in the present invention.

FIG. 7 shows an end view of one of the battens shown in FIG. 1. The batten 100 may be in the form of an aluminium extrusion. The batten 100 has side walls 102 joined by a transverse wall 104. The batten 100 includes a fabric cavity 106 and a band guide cavity or channel 108. Access to the band guide cavity 108 is through a guide slot 110, which extends from end to end of the batten 100. Access to the fabric cavity 106 is through a fabric slot 112. The ends 116, 118 of the side walls 102 are turned inwardly in order to make the slots narrower than the cavities. For example, the slots may be 3 mm wide and the cavities may be 6 mm wide.

Figure 8:
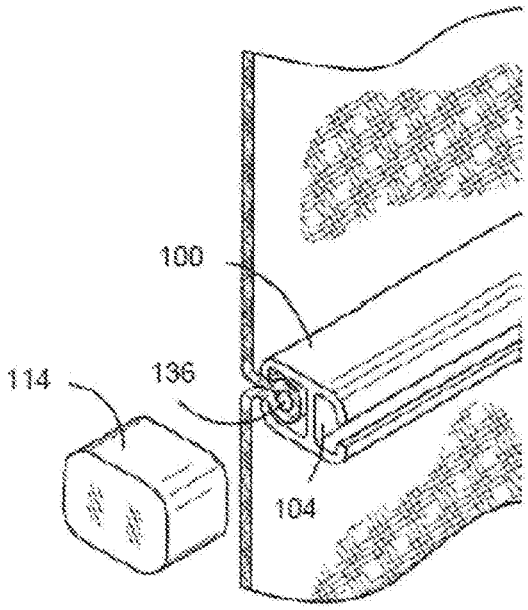
FIG. 8 shows a perspective view showing the fabric of the Roman blind being attached to the batten.

FIG. 8 shows how the fabric of the panel is folded as if to form a seam into the cavity from one open end. Once the fabric has been inserted, or during insertion into the cavity, a nylon rod 136 imprisons the fabric fold in the fabric cavity. In this manner, the batten becomes affixed to the panel 12 of the Roman blind 10. Optionally, the batten can then be dropped into a groove die and a presser beam is forced down upon the transverse wall to keep open the guide slot while tending to close the fabric slot. An end cap 114 is placed over the end of the batten in order to provide a neater appearance.

As can be seen from FIG. 1, the battens are mounted in a generally horizontal orientation, with the battens being essentially equally spaced from other battens. The battens may be spaced at any convenient distance apart that will provide an agreeable aesthetic to the finished Roman blind. For example, the battens may be from 8 to 12 inches (20 to 30 cm) apart.

Returning to FIG. 1, a plurality of band guides are mounted to the battens. As can be seen from FIG. 1, each batten has two band guides mounted thereto. For example, lowermost batten 28 has band guides 30 and 32 mounted thereto. Similarly, batten 26 has band guides 34, 36 mounted thereto. Each of the other battens 18 to 24 also has two band guides mounted thereto, although these band guides are not numbered in FIG. 1 for clarity. The manner of mounting the band guides to the battens will be described later.

The Roman blind 10 also is provided with two spaced control bands 38, 40. Although FIG. 1 shows the use of two control bands, a lesser number or greater number of control bands may be used. Control bands 38, 40 replace the control cords used in conventional Roman blinds. The lower ends of control bands 38, 40 are affixed to the lowermost band guides 30, 32 that are mounted to the lowermost batten 28. The upper ends of control bands 38, 40 are mounted to a rotating tube 42. The rotating tube 42 is normally positioned within a headrail or Cassette to provide an improved appearance to the Roman blind. The headrail or Cassette has been omitted from FIG. 1.

Rotating tube 42 is provided with a spring clutch mechanism that allows the blind to be lowered to any side level between fully retracted and fully extended. In order to extend the blind, an operator pulls downwardly on the drawbar 16 to lower the blind. When it is in the desired location, the operator simply releases the drawbar 16. Due to the construction of the spring clutch mechanism, the blind stays in that position. In order to retract the blind, an operator simply gives a short downwards tug on the drawbar 16, which releases the spring clutch mechanism and causes the spring clutch mechanism to rotate the tube 42 so that the control guides 38, 40 roll up on the tube 42, thereby raising the blind.

It will be appreciated that in the embodiment shown in FIG. 1, it is not necessary to provide a control chain to operate the blind. This further reduces strangulation hazard associated with the blind.

It is desired that the tube 42 be a cylindrical tube of constant diameter. This ensures that the control bands 38, 40 roll up into a smooth roll on the rotating tube 42.

Figure 2:
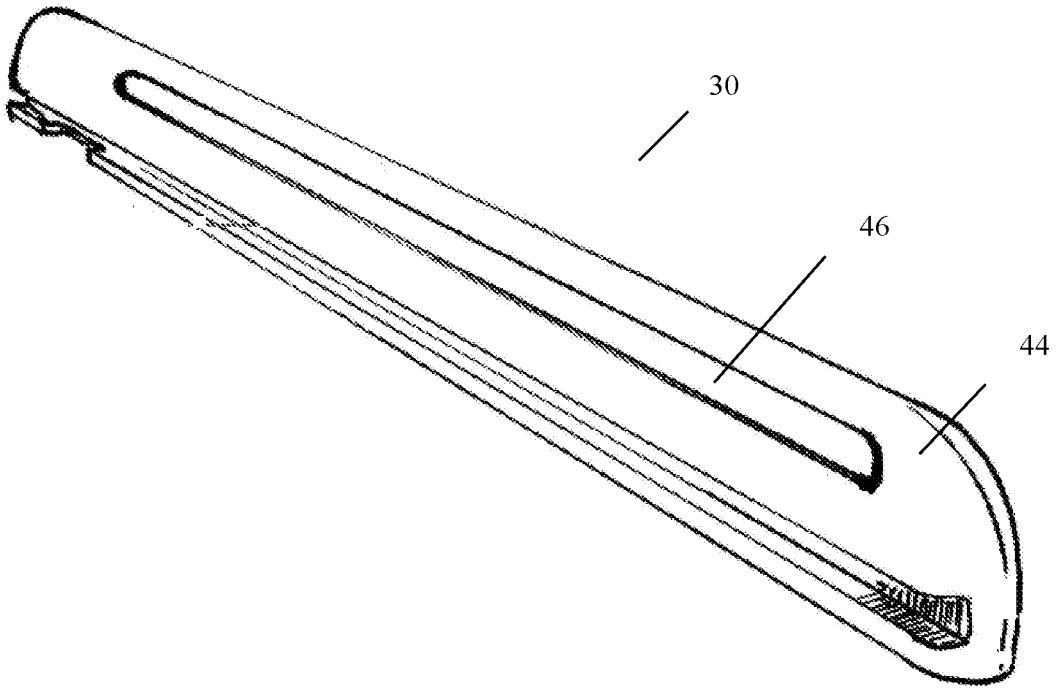
FIG. 2 shows a perspective view of a band guide suitable for use in the present invention.
Figure 3:
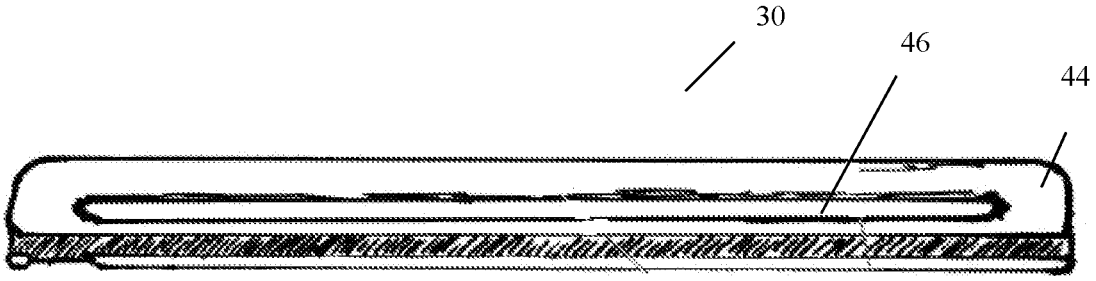
FIG. 3 shows a front view of the band guide shown in FIG. 2.
Figure 4:
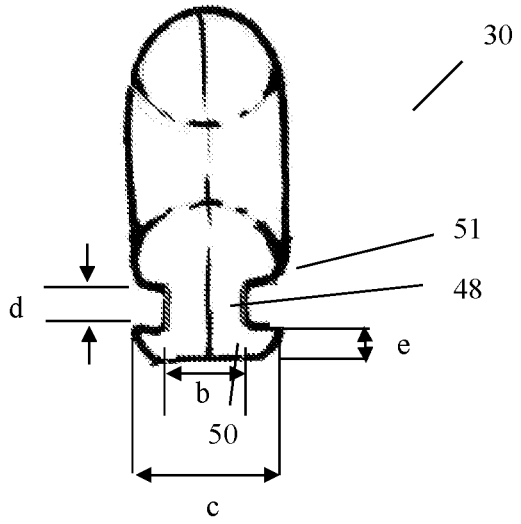
FIG. 4 shows an end view of the band guide shown in FIG. 2.

The band guides are shown in greater detail in FIGS. 2 to 4. In particular, band guide 30 comprises a body 44. The band guide 30 may be made from a plastic material, such as polycarbonate. The band guide may also be made from other plastic material, from wood or from metal, such as aluminium or steel. The body 44 includes an opening 46. Opening 46 is narrow but quite wide. The opening 46 has a width that is slightly greater than the width of a control band 38, 40. The opening 46 has a height that is slightly greater than the thickness of a control band 38, 40. In this way, the control band 38, 40 can easily move through the opening 46.

The band guide 30 further includes a neck 48 that extends into a head 50. This forms the mounting region of the band guide 30. The neck 48 is sized such that it can fit between the ends 116 that define the guide slot 110 of the batten 100. The head 50 is sized such that it fits into the cavity 108 defined by the transverse wall 104 and the sidearms 102 of the guide slot 110. However, head 50 has a width that is larger than the width of the opening of the guide slot 110. This ensures that the band guide 30 cannot be removed from the guide slot 110 by trying to pull the band guide 30 out of the guide slot 110. Removal and insertion of the band guide 30 can only occur by way of sliding the head 50 of the band guide 30 into the cavity 108 from the end of the guide slot 110 of batten 100. Furthermore, the relative dimensions of the cavity 108 and guide slot 110 of the batten 100 and the neck 48 and the head 50 of hand guide 30 allow the band guide 30 to slide relatively easily along the guide slot 110 of batten 100.

In one embodiment, the neck 48 of the band guide 30 is about 0.25 mm narrower than the corresponding longitudinal opening of the rear slot 110. The head 50 of the band guide 30 may be about 0.5 mm smaller in width than the width of the channel 108. The head portion 50 of the band guide may have a depth dimension that is about 0.25 mm smaller in depth than the corresponding inside dimension of the channel 108. The neck of the mounting arrangement of the band guide may have a height that is about 0.2 mm larger than the thickness of the wall of the rear slot.

The hand guide 30 may have a shoulder 51 located on an opposite end of the neck 48 to the head 50 and the distance between the head 50 of the band guide and the shoulder 51 of the band guide may be about 0.5 mm greater than the wall thickness of the rear slot.

The head 50 and 48 of the band guide 30 are suitably shaped such that they have no sharp corners or edges. Ideally, all corners or edges of the neck 48 and head 50 of the band guide 30 are rounded so that they do not catch on the channel 108 and slot 110 of the batten 100.

In this manner, although the band guide 30 is securely retained in the channel 108 and rear slot 110 of the batten 100 (in that it cannot be removed from the slot by pulling the band guide in a direction that is perpendicular to the plane of the blind), the band guide is free to slide easily along the channel and rear slot of the batten 100.

Returning now to FIG. 8, once the band guides 34, 36 have been inserted into the guide slot of batten 26, end caps 114 are mounted to the end of the batten. This provides an improved appearance whilst also minimising the likelihood that the band guides 34, 36 will be erroneously removed from the batten 26.

The band guides 34, 36 that are located on the battens that are not the lowermost batten 28 are able to slide or float along their respective batten. However, it is desired that the band guides 30, 32 that are mounted on the lowermost batten 28 are held in a fixed position. To achieve this, the band guides 30, 32 may be slid along the guide slot of batten 28 until they reached a desired position and then affixed in place by use of rivets, an adhesive or the like. In one embodiment, clips such as those shown in FIG. 4 of our Australian patent number 2007202581 (the entire contents of which are herein incorporated by cross-reference) may be positioned adjacent both ends of the respective band guides 30, 32 and the clips then locked in position in order to maintain the band guides 30, 32 in a fixed location.

In order to assemble the Roman blind, the battens are affixed to the panel 12, the band guides are mounted to the battens and the ends of the control bands 38, 40 are then fed through the openings of the band guides on each of the battens. The lower ends of the control bands 38, 40 are then fixed in position relative to the lower band guides 30, 32. This may be achieved in a number of different matters. For example, the lower ends of the control bands may be glued to the lowermost band guides. The lower ends of the control bands may be passed through the openings of the lowermost band guides and then moved back upwardly and joined to the band guides, for example, by gluing or sewing. This encloses the lowermost band guides in pockets formed in the bottom of the control bands. In other embodiments, the lowermost ends of the control bands may have a loop formed therein and a retainer, such as an oversized rod having a diameter that is larger than the width of the opening 46 in the band guide, is positioned in that pocket. When the control bands are lifted, the retainer is unable to pass through the opening 46 in the hand guide and therefore the control band cannot be lifted out of the lowermost band guide. The skilled person will appreciate that there may be a number of other techniques available to either affix the lower ends of the control bands to the lowermost band guides or to prevent removal of the lowermost ends of the control bands from the lowermost band guides by way of lifting the control bands.

During manufacture or assembly of the Roman blind 10 shown in FIG. 1 in accordance with an embodiment of the present invention, it is desired that the lowermost hand guides 30, 30 to be accurately positioned on the lowermost batten 28. However, as the intermediate band guides that are mounted to the battens 18 to 26 can slide or float along those battens, 100% accuracy in positioning of those intermediate band guides is not necessary. If an intermediate band guide is not quite properly aligned, the control band that passes through that band guide will tend to cause that intermediate band guide to slide or float to a correct aligned position. This simplifies manufacture. Furthermore, as it is not necessary to affix the intermediate being guides to their respective battens, any steps that may be required to affix hand guides to the battens are omitted in respect of the intermediate battens, again reducing manufacturing time and cost.

The control bands 38, 40 are suitably of a width that is sufficient to meet minimum width requirements specified by any regulations or legislation that relate to strangulation risks with blinds. In some embodiments, the control bands have a minimum width of 2 inches. More preferably, the control bands having minimum width of 4 inches. Even more preferably the control bands have a width of from 4 to 6 inches. The control bands may be made from a clear plastic, such as Mylar. It will be appreciated that the control bands may be made from a number of other different materials. The control bands are suitably made from a material that can be rolled up onto a roller, a tube or a spool.

Current United States regulations for Roman blinds that have the control cords specify that the battens cannot be spaced apart by more than 7 inches in order to minimise strangulation risk. However, as the control bands used in the present invention are sufficiently wide in themselves to minimise strangulation risk, the battens can be spaced further apart in Roman blind in accordance with the present invention. This allows the battens to be spaced apart by a distance that is desired by a designer to provide the aesthetic appearance that is required for the Roman blind.

As a further enhancement of minimising strangulation risk, the Roman blind 10 shown in FIG. 1 does not require a control chain to operate the Roman blind. Control chains themselves can cause a strangulation risk if not installed in accordance with the applicable legislation.

Figure 5:
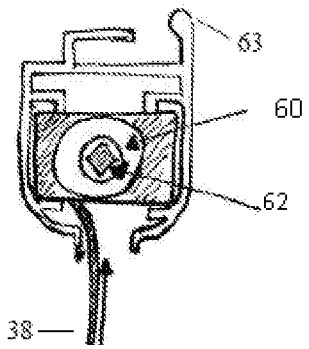
FIG. 5 shows an end view of a headrail assembly that can be used in the present invention.
Figure 6:
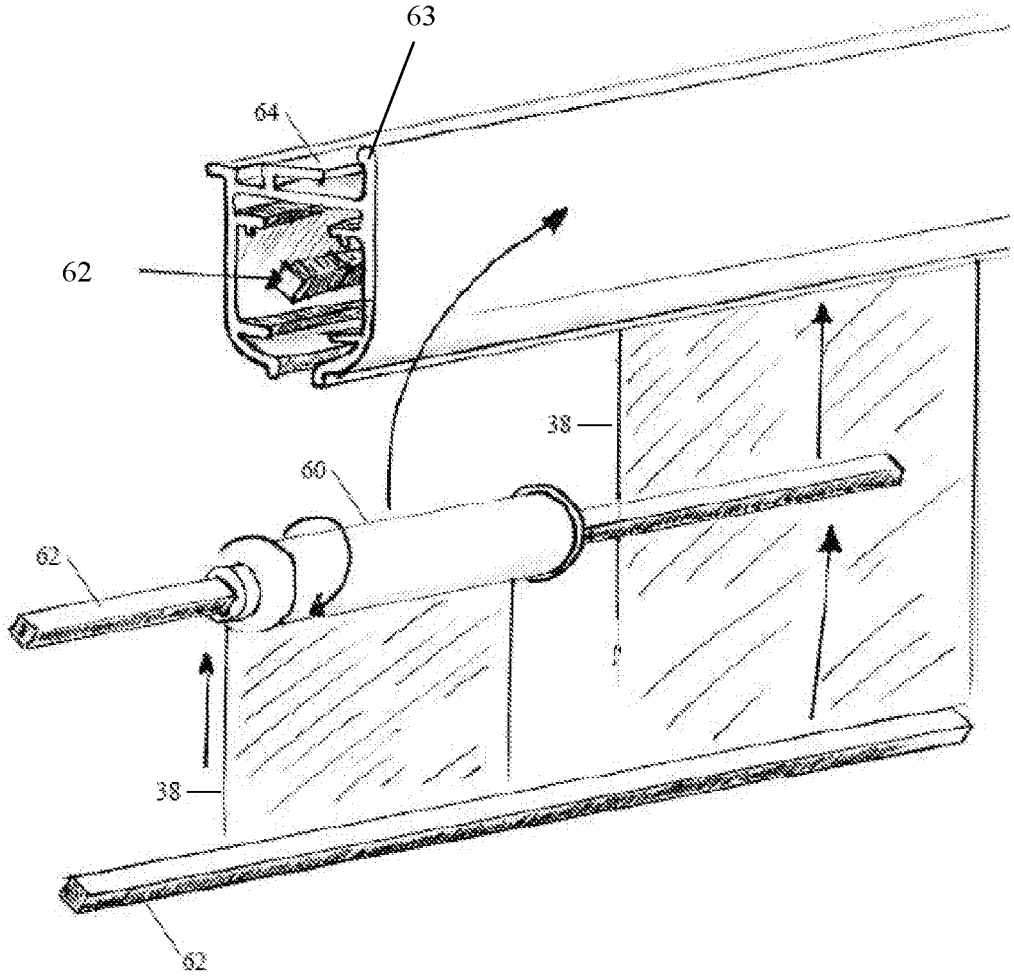
FIG. 6 shows a perspective view, partially apart and in line for assembly, of a headrail assembly that can be used in the present invention.

FIGS. 5 and 6 show an alternative arrangement in which the tube 42 used in the Roman blind of FIG. 1 is replaced with a smaller diameter spool 60. In particular, the spool 60 is keyed onto a square rod 62. It will be appreciated that the rod 62 may be of other cross-sectional shape, such as hexagonal or round. If the rod is round, an appropriate keyway may be formed on the rod and the spool. Control band 38 has its upper end attached to spool 60. The rod 62 is mounted inside a headrail 64. The rod 38 may extend along the length of the headrail and a second spool (not shown) may be used to roll up control band 40. The spool 60 has a diameter that can be significantly smaller than the diameter of tube 42. In this manner, when the control bands 38 is fully rolled up, the diameter of the rolled up control band is smaller than the diameter of the rolled up control band that will be found on tube 42 used in the embodiment of FIG. 1. This enables the headrail 64 to be of smaller size, which may be desirable from an aesthetic point of view or which may be useful in situations where there may be restricted for mounting the headrail 64.

Figure 9:
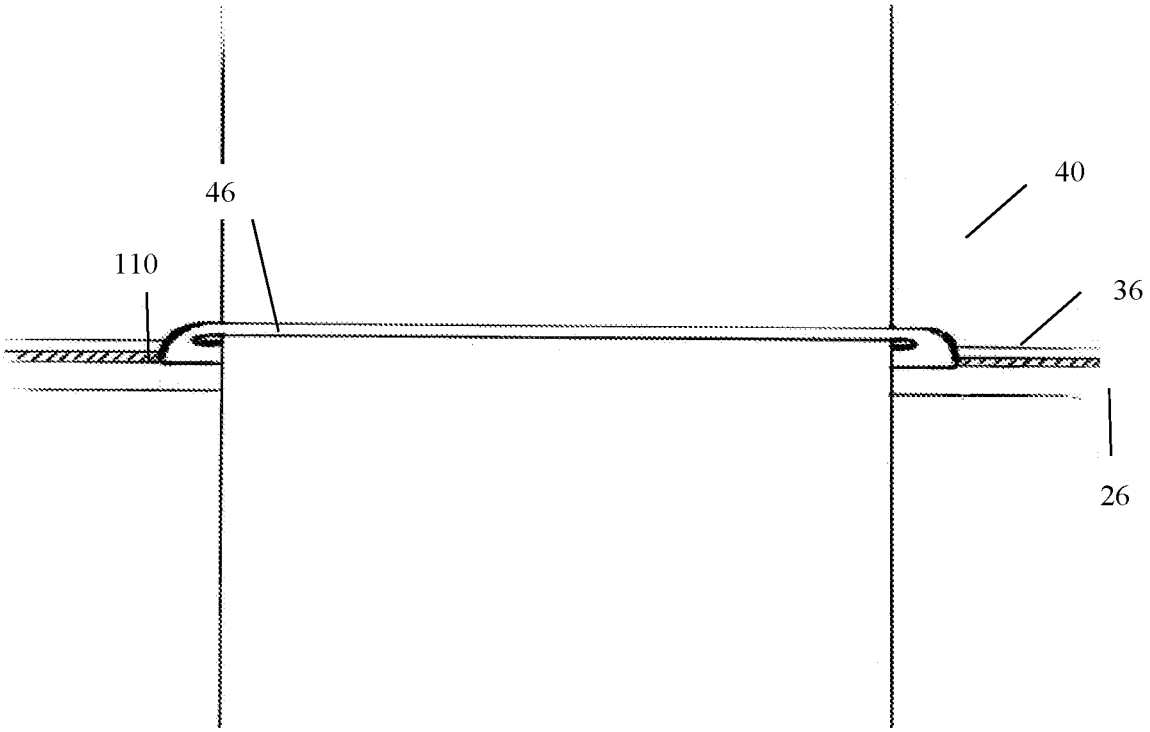
FIG. 9 shows a close-up view of a band passing through a band guide that is mounted to a rear slot of a batten.

FIG. 9 shows a close-up view of a control band 40 passing through being guides 36. Bang guide 36 is mounted to batten 26. In FIG. 9, it can be clearly seen that the control band 40 passes through the opening 46 in the band guide 36. The band guide 36 is mounted in the channel and rear slot 110 of the batten 26. As described hereinabove, the band guide 36 can freely float along the length of the batten 26 so that the hand guide 36 can self-adjust its position so that it becomes automatically aligned with the control band 40.

Figure 10:
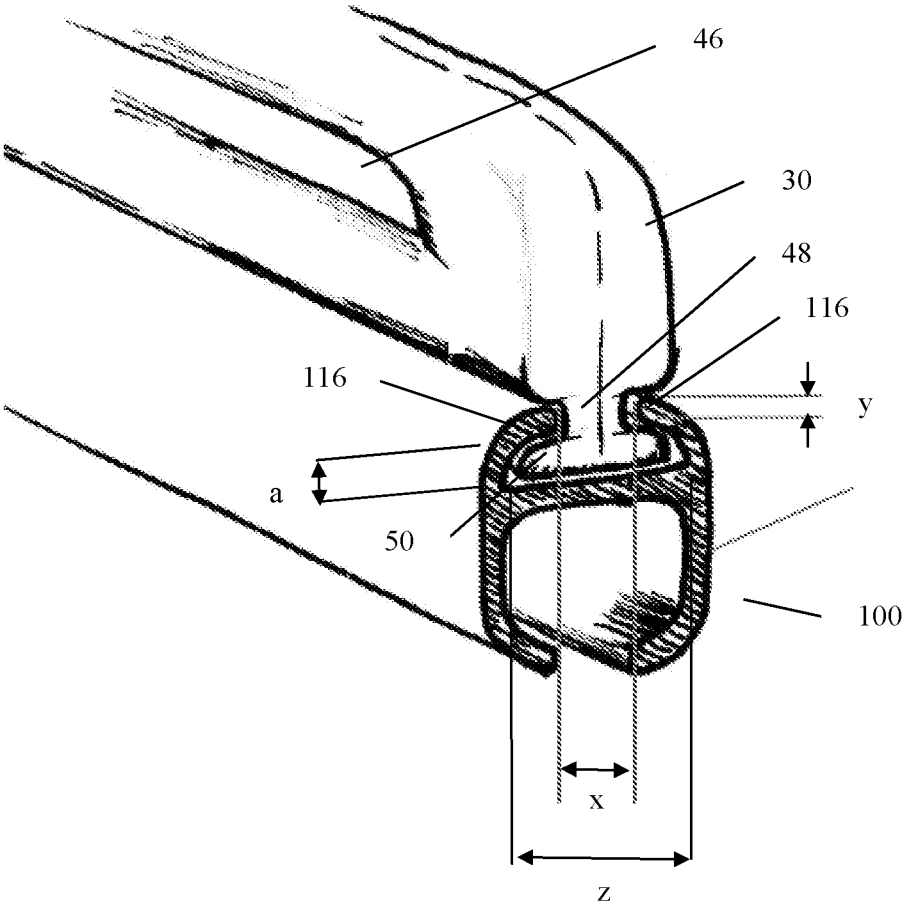
FIG. 10 shows a batten that is similar to that shown in FIG. 7 being fitted with a band guide that is similar to that shown in FIGS. 2 to 4.

FIG. 10 shows a batten 100 that is similar to that shown in FIG. 7 being fitted with a band guide 30 that is similar to that shown in FIGS. 2 to 4. In FIG. 10, the width of the rear slot that opens into the channel is given by the dimension "x", the thickness of the walls of the material that form the rear slot are given by the dimension "y", the width of the rear channel in the battens given by the dimension "z" and the height of the rear channel is given by the dimension "a" The width of the neck 48 of the band guide 30 is given by dimension "b" (see FIG. 4), the width of the head 50 is given by the dimension "c" the height of the neck 48 is given by the dimension "d" and the height of the head 50 is given by dimension "e". The dimensions for the band guide 30 are best shown in FIG. 4. In one embodiment, the width of the neck 48 of the band guide (dimension "b" is 2.5 mm. The width of the rear slot (dimension "x") is 3 mm. The height of the neck 48 of the band guide (dimension "d") is 2 mm and the thickness of the walls that form the rear slot (dimension "y") is 1.8 mm. The width of the channel in the patent (dimension "z") is approximately 7 mm and the width of the head of the band guide (dimension "c") is approximately 6.5 mm. The height of the channel (dimension "a" is approximately 2 mm at its largest extent and the height of the head of the band guide (dimension "e" is approximately 4.5 mm. The shape of the head may be complementary to the shape of the channel.

The Roman blind in accordance with the present invention provides a Roman blind that has a lower risk of strangulation. Assembly of the Roman blind is simple. It is not necessary to affix the band guides on the battens that are not the lowermost batten is, thereby simplifying and reducing the cost of manufacture. The band guides on the battens that are not the lowermost battens are able to self adjust to a correct, aligned position during operation of the Roman blind.

In the present specification and claims (if any), the word 'comprising' and its derivatives including 'comprises' and 'comprise' include each of the stated integers but does not exclude the inclusion of one or more further integers.

Throughout this specification, terms such as "front", "rear", "top", "bottom", "lower" and the like are use with reference to a Roman blind that has been mounted to a wall or to cover a window opening.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A Roman blind comprising a panel having a plurality of vertically spaced apart battens attached thereto, each of the battens other than a lowermost batten thereof including a rear slot, at least one control band extending along a rear surface of the panel, wherein raising a lower end of the at least one control band causes the blind to be raised and lowering the lower end of the at least one control band causes the blind to be lowered, and at least one band guide being mounted in the rear slot of one or more of the battens other than the lowermost batten, wherein the at least one band guide is mounted for slidable movement within the respective rear slot so that the at least one band guide floats in the respective rear slot; and wherein the lower end of the at least one control band is attached to a bottom part of the panel or to the lowermost batten or the lower end of the at least one control band is arranged such that it cannot be raised above the lowermost batten or a lowermost band guide, wherein the rear slot of each batten other than the lowermost batten opens into a channel in the batten and each band guide comprises a body having an opening formed therein, the opening having a dimension that is slightly larger than the at least one control band, the body further including a mounting arrangement comprising a neck portion extending into a head portion, wherein the neck of the mounting arrangement of each band guide has a width that is smaller than a width of a longitudinal opening of the rear slot thereof and a height that is larger than a wall thickness of an edge of the rear slot thereof and the head of the mounting arrangement of each band guide has a depth that is smaller than a depth of the channel of the rear slot thereof and a width that is smaller than a width of the channel of the rear slot thereof, such that the neck and head of the mounting arrangement of each band guide does not become tightly engaged within the channel of the rear slot thereof, thereby enabling each band guide to freely float along the length of the rear slot, the opening of each band guide through which the respective control band passes facing vertically, the band guide being able to freely float in the rear slot when the opening is facing vertically such that the band guide can self-align during use.

2. The Roman blind as claimed in claim 1, wherein the mounting arrangement of each band guide has rounded corners so as to not catch on any side or surface of a channel of the corresponding batten and outside surfaces of each band guide are smooth surfaces so as to not catch on any exterior surface of the corresponding batten or the rear slot in which each band guide is located.

3. The Roman blind as claimed in claim 1, wherein the battens are affixed to the panel by providing the battens with a front slot, inserting material from the panel into the front slot and then placing a retaining means in the front slot to thereby retain the material of the panel in the front slot.

4. The Roman blind as claimed in claim 1, wherein the battens are made from plastic, metal or wood, and the at least one band guide is made from plastic, metal, or wood.

5. The Roman blind as claimed in claim 1, wherein each batten other than the lowermost batten is provided with at least one band guide.

6. The Roman blind as claimed in claim 5, wherein the at least one control band comprises a plurality of control bands and wherein each batten other than the lowermost batten is provided with a corresponding plurality of band guides.

7. The Roman blind as claimed in claim 1, wherein the neck portion of each band guide is from 0.2 to 0.5 millimeters narrower than the corresponding longitudinal opening of the rear slot, and the head portion of the mounting arrangement of each band guide is from 0.3 to 0.7 mm smaller in width than the width of the channel, and the head portion of the mounting arrangement of each band guide has a depth dimension that is from 0.2 to 0.5 mm smaller than the corresponding inside dimensions of the channel, and the neck portion of the mounting arrangement of each band guide has a height that is from 0.15 to 0.4 mm larger than the thickness of the wall of the rear slot.

8. The Roman blind as claimed in claim 7, wherein the neck portion of each band guide is from 0.2 to 0.3 mm narrower than the corresponding longitudinal opening of the rear slot and the head portion of the mounting arrangement of each band guide is from 0.4 to 0.6 mm smaller in width than the channel and the head portion of the mounting arrangement of each band guide has a depth dimension that is from 0.2 to 0.3 mm smaller than the depth dimension of the channel and the neck portion of the mounting arrangement of each band guide has a height that is from 0.2 to 0.3 mm larger than the thickness of the wall of the rear slot.

9. The Roman blind as claimed in claim 7, wherein the neck portion of the band guide is about 0.25 mm narrower than the corresponding longitudinal opening of the rear slot and the head portion of the mounting arrangement of each band guide is about 0.5 mm smaller in width than the channel and the head portion of the mounting arrangement of each band guide has a depth dimension that is about 0.25 mm smaller in depth than the corresponding inside dimension of the channel and the neck portion of the mounting arrangement of each band guide has a height that is about 0.2 mm larger than the thickness of the wall of the rear slot.

10. The Roman blind as claimed in claim 1, wherein each band guide has a shoulder located on an opposite end of the neck portion to the head portion and the distance between the head portion of each band guide and the shoulder of each band guide is from 0.4 mm to 0.7 mm greater than the wall thickness of the rear slot.

11. The Roman blind as claimed in claim 10, wherein each band guide has a shoulder located on an opposite end of the neck portion to the head portion and the distance between the head portion of each band guide and the shoulder of each band guide is about 0.5 mm greater than the wall thickness of the rear slot.

12. The Roman blind as claimed in claim 1, wherein the lowermost batten is provided with a rear slot, and the rear slot of the lowermost batten has at least one band guide fixedly mounted therein and the at least one control band is fixed relative to the at least one band guide in the lowermost batten.

13. The Roman blind as claimed in claim 12, wherein the lower end of each control band passes through the opening of the lowermost band guide and the lower end of the control band is subsequently secured to the lowermost band guide or secured to itself at a position above the lowermost band guide to thereby retain the lower end of the control band in position relative to the lowermost band guide.

14. The Roman blind as claimed in claim 1, wherein the at least one control band has a width that is from 2 to 7 inches (5 to 17.5 cm).

15. The Roman blind as claimed in claim 14, wherein the at least one control band has a width that is from 4 to 6 inches (10 to 15 cm).

16. The Roman blind as claimed in claim 1, further comprising a mechanism for raising and lowering the Roman blind.

17. The Roman blind as claimed in claim 16, wherein the mechanism includes a rotating spool or a rotating tube or roller onto which the at least one control band can wind and unwind.

* * * * *